United States Patent [19]

Goulter et al.

[11] Patent Number: 4,946,065

[45] Date of Patent: Aug. 7, 1990

[54] HOLDER FOR HAND-CARRYING PLASTIC BAGS OR SUPPORTING SAME WITHIN TRASH CONTAINER WITH BAG HANDLE INSERTED IN SPACE UNDER HOLDER

[75] Inventors: Victor H. Goulter; Brian A. Brown, both of San Francisco, Calif.

[73] Assignee: David Pressman, San Francisco, Calif. ; a part interest

[21] Appl. No.: 869,827

[22] Filed: May 30, 1986

Related U.S. Application Data

[63] Continuation of Ser. No. 724,910, Apr. 19, 1985, abandoned.

[51] Int. Cl.[5] ..... B65D 25/22; B65D 25/08; B65D 33/06; B65D 90/04

[52] U.S. Cl. ..... 220/404; 24/3 J; 24/3 L; 24/545; 24/563; 220/908; 220/96; 224/218; 248/95; 383/6; 383/68; 294/27.1

[58] Field of Search ..... 220/404, 1 T, 74, 96; 248/95, 101; 24/3 E, 3 J, 3 L, 563, 556, 555, 545, 447, 546; 386/6, 68; 297/27.1

[56] References Cited

U.S. PATENT DOCUMENTS

| | | | |
|---|---|---|---|
| D. 516,253 | 11/1951 | Ward | 224/252 X |
| 1,206,074 | 11/1916 | Zwiener et al. | 224/252 X |
| 1,496,388 | 6/1924 | Stern | 24/555 X |
| 1,627,145 | 5/1927 | Breed | 224/252 X |
| 1,730,959 | 10/1929 | Warfield, Jr. | 248/305 X |
| 2,343,678 | 3/1944 | Larkin | 383/69 X |
| 2,711,637 | 6/1955 | Wells | 24/555 X |
| 2,768,775 | 10/1956 | Houser | 224/252 X |
| 2,796,309 | 6/1957 | Taylor | 220/404 X |
| 2,823,004 | 2/1958 | Melloh | 248/305 X |
| 3,089,211 | 5/1963 | Perusse | 24/556 |
| 3,458,110 | 7/1969 | Goldman | 24/555 X |
| 3,516,571 | 6/1970 | Roper et al. | 220/74 X |
| 3,575,371 | 4/1971 | Carlstedt | 248/215 |
| 3,624,873 | 12/1971 | Frey | 24/555 |
| 3,796,402 | 3/1974 | Trotta | 248/101 X |
| 3,916,962 | 11/1975 | Stott | 248/101 X |
| 3,963,156 | 6/1976 | Perrin | 224/265 |
| 3,977,450 | 8/1976 | Schampier | 220/404 X |
| 4,296,958 | 10/1981 | Stranders | 294/27.1 |
| 4,332,060 | 6/1982 | Sato | 24/545 X |
| 4,358,036 | 11/1982 | Mattais | 224/252 |
| 4,416,197 | 11/1983 | Kehl | 220/1 T |
| 4,418,835 | 12/1983 | Watts | 220/1 T X |
| 4,535,911 | 8/1985 | Goulter | 220/1 T X |
| 4,563,796 | 1/1986 | Kettlestrings | 24/555 X |

FOREIGN PATENT DOCUMENTS

| | | | |
|---|---|---|---|
| 2725481 | 12/1978 | Fed. Rep. of Germany | 383/15 |
| 527100 | 10/1921 | France | 224/97 |
| 220459 | 8/1924 | United Kingdom | 248/215 |
| 355745 | 8/1931 | United Kingdom | 220/1 T |
| 2078497 | 1/1982 | United Kingdom | 224/268 |

*Primary Examiner*—Allan N. Shoap
*Attorney, Agent, or Firm*—David Pressman

[57] ABSTRACT

A plastic open-ended generally U-shaped holder (25) has three sides (31, 33 and 35) of suitable area for advertising. The free ends of the legs of the U are bent together and flared out to form a slot (37). This can be parted with the fingers so as to fit over the top edge of a waste basket (38), the handles (40) of plastic grocery bags (26) can be anchored within the attachment in order to suspend said bags in open and upright position for receiving waste for disposal. Holder (25) can also be used when inverted to receive and embrace handles (40) of one or more plastic bags (26) so as to provide a handpiece (25) for comfortable carrying of bags (26) to and from a vehicle. In the vehicle, or elsewhere, the holder holds said handles clustered together so as the prevent rolling and spilling of the contents of said bags during travel. At a destination, the said bags can then be collectively removed and carried to the kitchen with speed and ease. Another holder design (45) has two plastic bag handle anchor points (55 and 42) for selective anchorage of the bag handle. Another holder (61) has two anchor points (65 and 71) for attaching plastic bag handles as well as an easy-to-use channel (64). Two other holders (80 and 88) have tongues with pressure point (81 and 89) which bear against the outer trash basket's wall between reinforcing gussets (**41*a* and 41*b*) and an inside pressure point (85*a* and 90) which bear against its inside wall (91). Also, top lugs (80*a* and 80*b*) provide alternative anchorage anchor points as well as two other inside wall anchor points (82 and 86) on holder (80**).

20 Claims, 4 Drawing Sheets

36
77
90
38b
88
89
41a 40
82
85
87
86
80
41a 36
90
41a
40
88
89
41b 81b
36
80b
41a
80
81
80a
81a
41b 89
90
88

87
86
80

HOLDER FOR HAND-CARRYING PLASTIC BAGS OR SUPPORTING SAME WITHIN TRASH CONTAINER WITH BAG HANDLE INSERTED IN SPACE UNDER HOLDER

This application is a continuation of Ser. No. 06/724,910 filed Apr. 19, 1985, and now abandoned.

BACKGROUND

1. Field of the Invention

This invention relates to metal or plastic holders, particularly to such holders for supporting plastic bags within trash containers and for carrying such bags.

2. Description of Prior Art

Heretofore, handled plastic bags have been used to carry groceries, but, until recently, they were not readily useable for trash storage or disposal as were conventional paper shopping bags. This is because such plastic bags were not stiff enough to be self-supporting within a trash container, as were paper bags.

A solution to this problem was provided by the invention of application Ser. No. 06/607,797, filed 1984-05-07, of Victor Harold Goulter, now U.S. Pat. No. 4,535,911, issued 1985 Aug. 20. In said Goulter invention, upstanding holders were provided for attachment to a trash container; thus the handles of a grocery bag could be suspended from such holders and within such container so that the plastic grocery bag could be used for trash storage and disposal.

While a useful solution, the Goulter invention did provide upstanding supports, which increased the height of the overall trash container. Also, it had a relatively complex shape. Further, it had only one area of utility—the provision of support for a handled plastic bag—and had other limitations as well.

OBJECTS AND ADVANTAGES

Accordingly, one main object of the present application is to provide a better design and to better make use of plastic material in the manufacture of a holder for holding plastic grocery bags onto trash containers. Another object is to provide such a holder, which can be easily fitted to a trash basket for holding the plastic bags for waste disposal. A further object is to provide such holders which can be made in a variety of colors, thereby to match to more common standard colors of existing waste disposal baskets. Another object is to provide such holders which have enough surface area on the top and sides for the imprinting or other attachment of advertising logos. Yet another object is to provide such a holder wherein the handle of the grocery bag can be slipped upward to engage the holding section of the holder. Another object is to provide a holder which completely covers the reinforced "stops" which are molded into trash baskets to prevent such baskets from locking together when they are packed one inside another for shipping and storing. Yet another object is to provide such holders which can be fitted under plastic grocery bag handles, thus providing a comfortable and convenient hand-hold for carrying. A further object is to provide a means of carrying several plastic grocery bags simultaneously without discomfort, making it possible to carry several full bags in one hand. An additional object is to provide a holder for holding the handles of several bags together when they are placed on a surface, as in the trunk of a car, thus providing means to prevent the individual bags from rolling, tipping, or spilling their contents. An additional object is to provide such a holder which is simple in design, easy to make, and which does not increase the height of a tras container.

A further object of the invention is to provide a holder which can be manufactured by vacuum injection, rather than pressure injection, resulting in lower manufacturing cost and a lower cost to the consumer. Further objects and advantages of the invention will become apparent from a consideration of the drawings and the ensuing description thereof.

Figure 3:
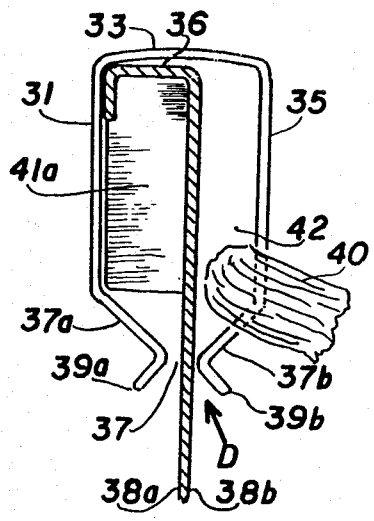
FIG. 3 is a sectional view of the holder of FIG. 1 when fitted to a wastebasket.

REFERENCE NUMERALS 25 holder
26 plastic grocery bag
27 open end
29 other open end
31 side
32 top surface
33 top side
35 side
36 top rim of basket
37 slot
37*a* inwardly bent section
37*b* inwardly bent section
38 basket
38*a* outer wall of side
38*b* inner wall of side
39*a* outwardly bent section 39*b* outwardly bent section
40 bag handle
41*a* stops or ribs
41*b* stops or ribs
42 space
45 holder
47, 49, 51 sides
52 split side
53 member
55 channel
61 holder
63 outer face
64 open slot
65 groove
66 holder
67 pressure point
68 inside wall
69 diverging section
70 Vee entry
71 groove
73 member
74 inside wall
75 sloping section
76 pressure edge
78 anchoring channel
79 section
80 holder
80*a* extended side lugs
80*b* extended side lugs
81 tongue
81*a* horizontal groove
81*b* horizontal groove
82 anchoring channel
85 diverging section
86 anchoring groove
87 section
88 holder
89 tongue
90 pressure point

DESCRIPTION—FIGS. 1-5—PREFERRED EMBODIMENT

Figure 1:
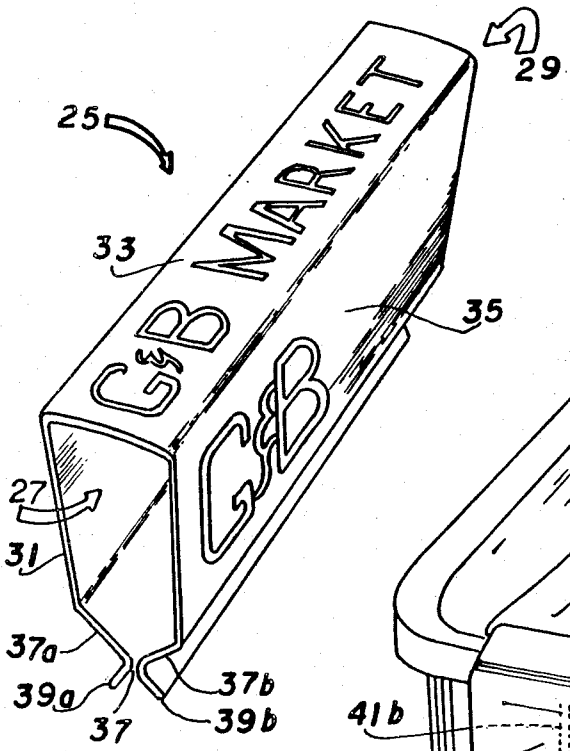
FIG. 1 is an elevated perspective view of one preferred embodiment of the improvement.

According to the preferred embodiment of the invention (FIG. 1), holder 25, which is preferably made of plastic (or any suitable material with elastic properties) is U-shaped in end view (FIG. 3), but is normally used and is shown inverted. The holder is open at each end 27 and 29, and has an elongated configuration perpendicular to the plane of the U. Also, the free ends of the legs of the U are bent in and then flare out as will be described. Top surface 33 and sides 31 and 35 are flat or slightly curved and have outer surfaces with sufficient space for imprinting advertising logos for the wholesaler or retailer, as shown in FIG. 1. The bottom side has a slot 37 formed by inwardly bent sections 37*a* and 37*b*, which are angled downward and inward, and outwardly bent sections 39*a* and 39*b*. Sections 37*a* and 37*b*, 39*a* and 39*b*, extend for the length of holder 25 and provide two contacting convex elongated portions which form slot 37.

Figure 2:
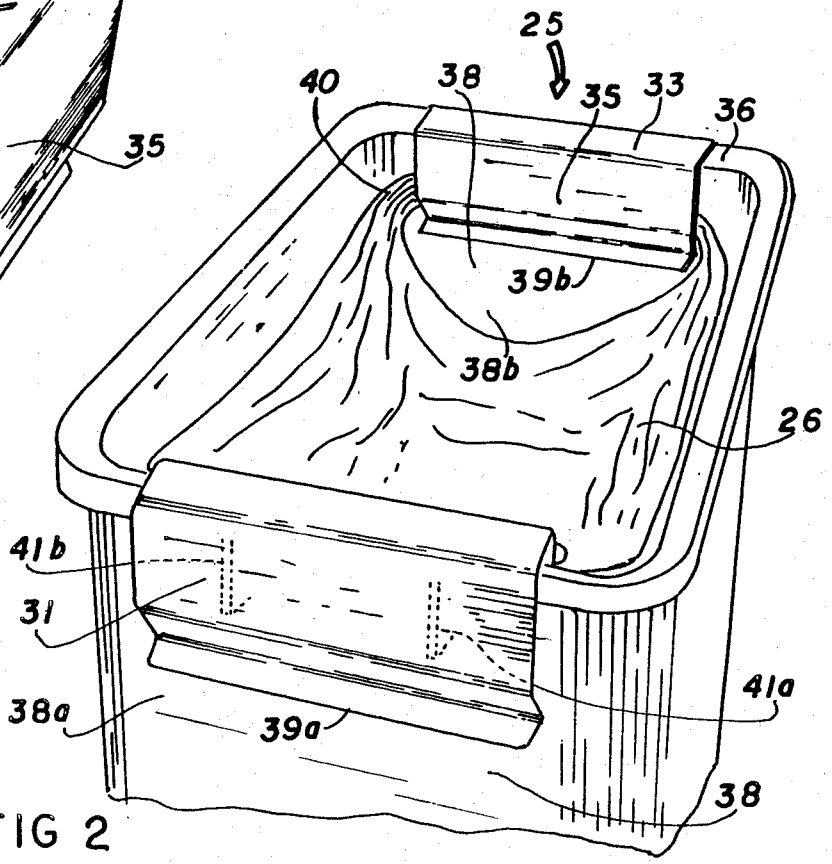
FIG. 2 is an elevated perspective view of FIG. 1 when fitted to a wastebasket.

Sections 39*a* and 39*b* provide finger-grips for opening slot 37 during fitting (and other uses to be described below). I.e., sections 39*a* and 39*b* are pulled in opposite directions, thus opening slot 37 sufficiently to fit the holder 25 over a top rim 36 of basket or container 38 (FIG. 2) and down both outside surface 38*a* and inside surface 38*b*. Holder 25 is pushed down until it completely covers reinforcing stops or ribs 41*a* and 41*b* as best shown in FIG. 3. Sections 39*a* and 39*b* are then released, allowing holder 25 to clamp over reinforcing stops or ribs 41*a* and 41*b* and against outer and inner walls 38*a* and 38*b* of basket 38. Then handles 40 (FIG. 2) of a plastic grocery bag can be fitted onto holder 25. Handle 40 can be fitted in the direction of arrow D (FIG. 3), either after holder 25 has been fitted over basket's side 38, or else it can be pulled through slot 37 so that it is held inside holder 25 before it is fitted to the basket. As shown, the holders are each long enough to spread the bag's handles, and thus the bag, open when said handles are respectively inserted thereunder (FIG. 2), and are also long enough to cover the width of an adult human hand (FIG. 4).

USE OF HOLDER AS CARRYING HANDLE—FIGS. 4 AND 5

Figure 4:
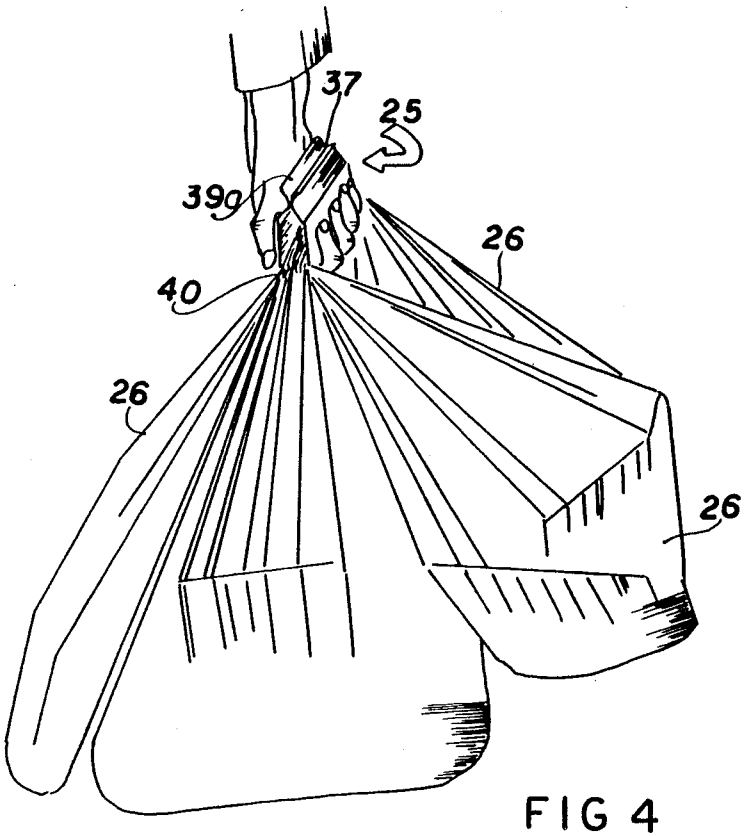
FIG. 4 is a perspective view of the holder being used to accommodate the six handles of three plastic grocery bags for the purpose of carrying the bags.

As shown in FIG. 4, holder 25 can also be used for carrying several plastic grocery bags 26. To do this, holder 25 is inverted and handles 40 of several bags are pulled down through slot 37, the 25 embracing handles 40 and forming a comfortable carrying handpiece for one of more grocery bags.

Figure 5:
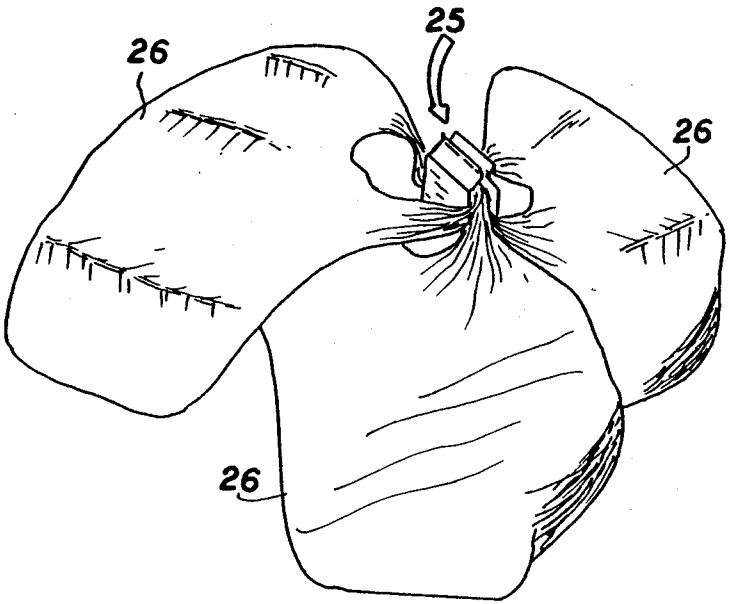
FIG. 5 is a perspective view of the three bags of FIG. 4 placed in the trunk of a car.

Furthermore, when the bags so carried are placed on any surface, as the trunk of a car, as shown in FIG. 5, holder 25 will prevent them from rolling from side to side during travel, by securely holding handles 40 together.

Also, upon arrival at the destination, all bags can be lifted together at once, without loss of time, and carried indoors in a single operation.

FABRICATION

Holder 25 preferably is made of a rigid yet yieldable plastic, such as polycarbonate. Its length is 15 cm (6 in), its overall thickness (left to right in FIG. 3) is 2.75 cm ($1\frac{1}{8}$ in), its height (FIG. 3) is 6.5 cm ($2\frac{1}{2}$ in), its material thickness is 1.5 mm ($\frac{5}{8}$ in), and its other dimensions are sized proportionally. It is preferably made by vacuum injection molding.

Figures 6, 7, 8, 9, 10, 11:
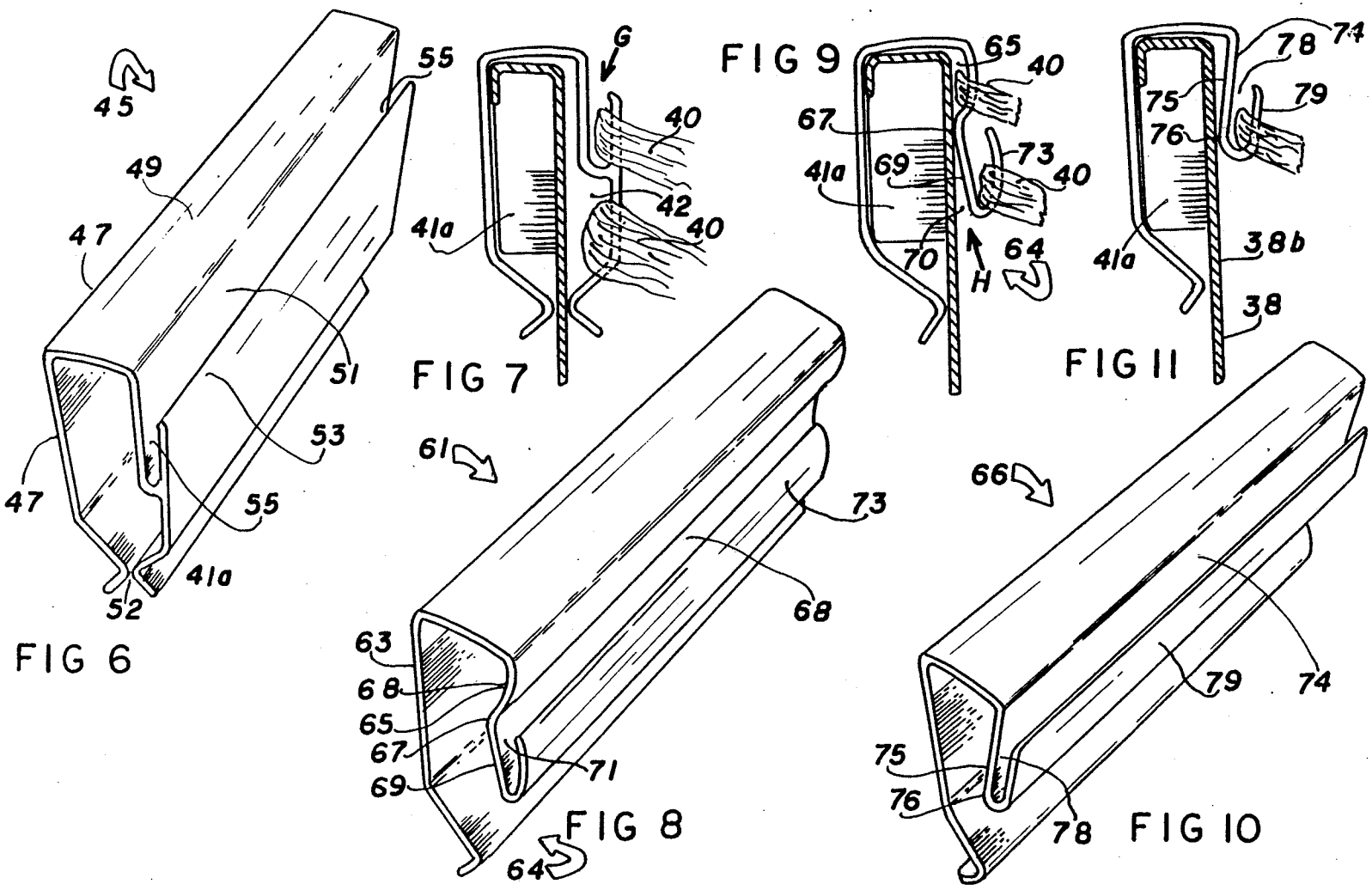
FIG. 6 is a perspective view of a second preferred embodiment of the holder.
FIG. 7 is a sectional view of the holder of FIG. 6 fitted to the side of a waste basket, and showing two different ways to attach plastic bag handles.
FIG. 8 is a perspective view of a third preferred embodiment of the present improved holder.
FIG. 9 is a sectional view of the holder of FIG. 8 fitted to a waste basket, showing two methods of attaching plastic bag handles.
FIG. 10 is a perspective view of an alternative design for the holder for holding plastic bags in waste baskets.
FIG. 11 is a sectional view of the holder of FIG. 10 fitted to a waste basket.

DESCRIPTION—FIGS. 6 and 7—SECOND EMBODIMENT

In another embodiment, shown in FIG. 6, holder 45 has four sides, 47, 49, 51, and a split fourth side 52. This holder is similar to holder 25 (FIG. 1) and can be used in the same ways. However, in addition, it has an upward facing channel 55 formed on side 51 by member 53. Channel 55 provides an alternative anchorage (FIG. 7) for holding handles 40 of plastic grocery bags 26, in addition to space 42 within the holder. To place handle 40 into channel 55, it is moved downward in the direction of arrow G until it rests in channel 55. Alternatively, as stated, handle 40 may be inserted into space 42 by moving it upwardly in the same manner as for holder 25 of FIG. 1. This attachment also embodies the bag-carrying capabilities of the preferred embodiment show in FIGS. 1-5.

OPEN CHANNEL HOLDER—FIGS. 8 AND 9

FIG. 8 show an open channel design holder 61. This holder has an outer face 63 similar to that shown in 31 of FIG. 1, but has an open slot 64 at the bottom. This makes it extremely easy to fit holder 61 over the side of a basket. An inside wall 68 consists of a groove 65, a pressure ridge 67, and a diverging section 69, which is then turned upward to form a channel or groove 71 behind member 73 for anchoring plastic bag handles.

Alternatively, bag handle 40 can be passed upwards through inverted Vee entry 70 in the direction of arrow H until it is embraced by groove 65. Holder 61 may also be used as a carrying handle for plastic grocery bags by inverting it and inserting the bag handles downward through opening 64.

ALTERNATIVE DESIGN FOR HOLDER—FIGS. 10 AND 11

Holder 66 of FIGS. 10 and 11 is similar to the one shown in FIGS. 8 and 9, except that it provides only one means of anchoring a grocery bag handle. Inside wall 74 consists of an inward and downward sloping section 75. The end of section 75 forms a pressure edge 76 which rests against wall inside face **38*b* of basket side 38. It is turned upward to form an anchoring channel 78 behind section 79**. This holder may also be used as a carrying handle for filled grocery bags.

MULTI-ANCHOR DESIGN HOLDER—FIGS. 12–14

Figures 12, 13, 14, 15, 16, 17:
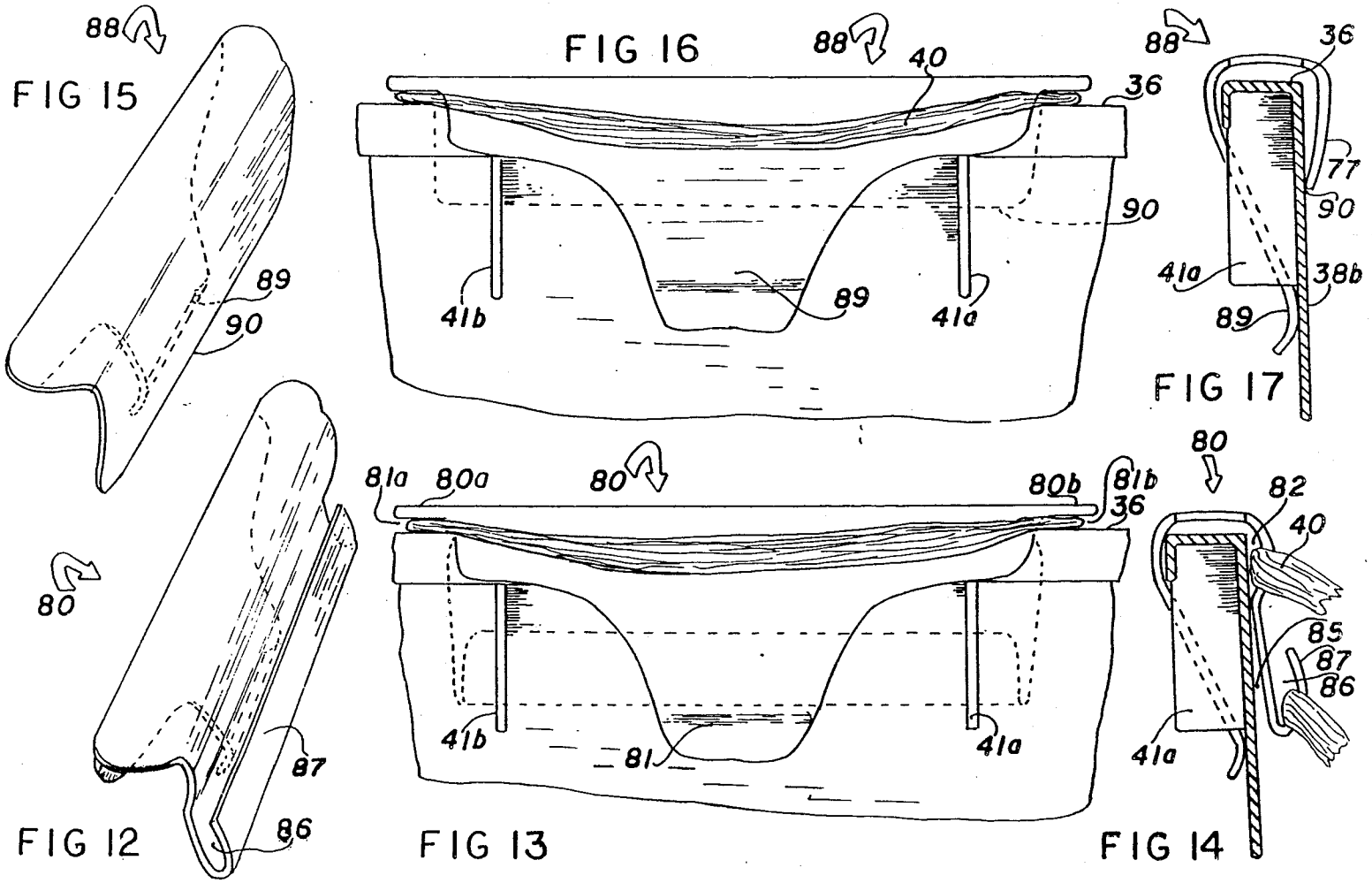
FIG. 12 is a perspective view of a second alternative design for a plastic holder, which can hold the handles of grocery bags in three different ways.
FIG. 13 is a side perspective view of the holder of FIG. 12 fitted to a waste basket, showing one of the three ways to attach bag handles.
FIG. 14 is a sectional view of the holder of FIG. 12, showing the further two ways to attach the handles of grocery bags.
FIGS. 15–17 are respective views of a simple form of holder for holding plastic grocery bag handles in one way to a trash basket.

Holder 80 of FIGS. 12 and 13 consists of a pressure tongue 81 which fits between reinforcing stops or ribs **41*a* and 41*b* of basket or container Tongue 81 bears against the basket's outside wall 38*a*. Its top surface has extended side lugs 80*a* and 80*b* which are spaced from yet cooperate with basket top 36 to form horizontal grooves 81*a* and 81*b* for anchoring plastic bag handle 40. The inside wall is buckled or bulged to provide an inside anchoring channel 82. Also, such wall has, at its free end, a diverging section 85 which is turned upwards to form an anchoring groove 86 behind section 87**.

SINGLE ANCHOR DESIGN—FIGS. 15–18

Holder 88 of FIGS. 15–17 has a pressure tongue 89. Holder 88 has a top section as in FIGS. 12–14; however, its inside wall is bent downward and inward to form a pressure edge 90 which presses against the basket's inside wall **38*b*, midway between the basket's top 36 and the tongue's pressure point 89**.

SCOPE

While the foregoing description contains many specificities, these should not be construed as limitations on the invention's scope, but rather as exemplifications of the preferred and alternative embodiments thereof. Many other variations are possible within its scope. For example, the attachment of FIGS. 1–3 can have rounded bends, or it can be perforated.

Accordingly, the full scope of the invention should be determined, not by the examples given, but by the appended claims and their legal equivalents.

We claim:

1. A pair of holders for manually carrying one or more handled plastic grocery bags and for supporting one of such bags within a container of the type having flat, thin, vertical side walls and an open top with a relatively wide horizontal rim which has a predetermined cross-sectional area and which forms an overhanging ledge above the sides of said container, said holders each being made of a sheet of elastic material which is formed to have a generally U-shaped configuration when seen from an end thereof in a given direction normal to the plane of said "U", said holders each being elongated in said given direction for about the width of an adult human hand and so that when placed over opposite sides of said container with the handles of a plastic grocery placed thereunder, respectively, said handles will each be spread enough to hold said bag open, the legs and bight portion of each of said holders having a relatively small thickness, when measured in directions perpendicular to said direction of elongation, in relation to the length of the legs of said "U" and in relation to the length of said "U" in said given direction, said legs of each said holders being spaced apart at least as far as the width of said widened top rim of said container, said legs of each of said holders having free ends which are bent inwardly toward each other so that said free ends are spaced apart less than the width of said widened top rim, each of said holders being shaped so that (a) when its legs are spread apart with said "U" upside down and said holder is placed over said widened top rim and pressed down as far as possible, with one said legs on the inside of said container, and said legs are allowed to spring back, sufficient space will exist between the inside of said side wall of said container and said one leg to accommodate a handle of said plastic grocery bag, (b) the free end of said one leg will contact and press against the inside of said side wall, and (c) said handle of said plastic grocery bag, when placed in said space, will be retained in said space and will not fall out of said space unless pulled down with a force in excess of a predetermined value.

2. The invention of claim 1 wherein each of said holders has a generally rectangular configuration when seen from a direction parallel to the plane of said "U" and is at least 8 centimeters long in said given direction.

3. The invention of claim 1 wherein the free ends of the legs of each of said holders is bent to flare outwardly at portions thereof beyond the portions thereof which are bent inwardly, thereby to form facing convex edges.

4. The invention of claim 3 wherein said facing convex edges touch when said holders are in their free state.

5. The invention of claim 1 wherein the bight portion of each of said holders comprises two generally-right-angled bends and a generally flat section interconnecting said legs of said holder.

6. The invention of claim 1 wherein said legs of each of said holders are long enough to fit over a stiffening rib of a predetermined length which extends down an outside surface of said container from said widened rim thereof.

7. The invention of claim 1 wherein one leg of each of said holders is narrowed from the bight portion of said holder so as to form a narrow leg which is dimensioned to fit between a pair of stiffening ribs which extend down from said widened rim of said container and which are spaced apart by a predetermined amount.

8. The invention of claim 1 wherein said one leg of each of said holders which is narrowed is substantially longer than the other leg thereof.

9. The invention of claim 1 wherein the free end of one leg of each of said holders is bent around and back toward the bight portion of said holder so as to provide a 180-degree bend which forms a hook portion so as also to be able to hold a handle of said plastic grocery bag outside the U-shaped portion of said holder.

10. The invention of claim 1 wherein one leg of each of said holders has a flap which extends from a portion of a leg of said holder intermediate the bight portion thereof and the free end thereof toward the bight portion of said holder and is spaced from said one leg of said holder so as to form a hook portion for also holding a handle of said plastic bag outside the U-shaped portion of said holder.

11. The invention of claim 1 wherein each of said holders has advertising symbols thereon.

12. A method for supporting plastic grocery bags within a container, comprising:

(a) providing a container of the type having flat, relatively thin, substantially vertical side walls of a predetermined thickness and an open top with a relatively wide, substantially horizontal rim of a predetermined thickness, said rim having a predetermined cross-sectional area and forming an overhanging ledge above the sides of said container, (b) providing a pair of holders, each of which:

is formed of an elastic material which has a generally U-shaped configuration when seen from an end thereof in a given direction normal to the plane of the "U", is elongated in said given direction for about the width of an adult human hand and so that when placed over opposite sides of said container with the handles of a plastic grocery bag placed thereunder, respectively, said handles will each be spread enough to hold said bag open, has a pair of legs and bight portion of a relatively small thickness, when measured perpendicular to said direction of elongation, in relation to the length of the legs of said holder and in relation to the depth of said holder in said given direction, has legs which are spaced apart at least as far as the width of said widened top rim of said trash container, and has legs which have free ends which are bent inwardly toward each other so that said free ends are spaced apart less than the width of said widened top rim, is shaped so that (1) when said legs of said holder are spread apart with said holder upside down and said legs are placed over said widened top rim, and said holder is pressed down as far as possible, with one of its legs on the inside of said container, and said legs are allowed to spring back, sufficient space will be provided between the inside of said side wall of said container and said one leg to accommodate a handle of said plastic grocery bag and so that the free end of said one leg will contact and press against the inside of said side wall so that said handle of said plastic grocery bag will be retained in said space and will not fall out of said space unless pulled down with a force in excess of a predetermined value, and (2) the area inside said holder will be greater than said cross sectional area encompassed by said relatively wide rim of said container, so that sufficient excess area will be provided within said holder to accommodate said handle of said plastic grocery bag, (c) spreading apart the legs of each of said plurality of said holders, and, with said holders upside down, placing each of said holders over said widened top rim of said trash container, at opposite sides thereof, pressing down each of said holders as far as possible, and allowing the legs of said holder to spring back, and (d) placing a plastic grocery bag within said container and inserting the handles of said plastic grocery bag up into the space between said one of said legs of each of said holders which is inside said container and the side wall of said container so that each of said handles of said plastic grocery bag will be retained in a respective one of said spaces.

13. A pair of holders for supporting plastic bags in an open condition within a container of the type having flat thin, substantially vertical side walls and an open top with a wide, horizontal rim having a predetermined cross-sectional area which forms an overhanging ledge above the sides of said container, each of said holders of said pair being made of an elastic material and having a flat center portion and two flat legs extending at generally right angles to said center portion, the free ends of said legs being bent inwardly toward each other, each of said holders being elongated in a direction perpendicular to said center portion and said legs for at least width of an adult human hand and so that when placed over opposite sides of said container with the handles of a plastic grocery bag placed thereunder, respectively, said handles will each be spread enough to hold said bag open, said center portion and said legs being shaped and dimensioned so that (a) if said holder is positioned over a said container with said "U" upside down and said legs spread apart, and said holder is pressed down as far as possible, said legs will grasp a side wall of said container and a space will be provided between the one of said legs which is inside of said container and said side wall of said container which is straddled by said holder so that the handle of a plastic grocery bag, when placed within said space, will be held within said space and cannot be withdrawn unless pulled out of said space with greater than a predetermined force, and (b) the area inside said legs and said center portion will be greater than said cross sectional area encompassed by said relatively wide rim of said container, so that sufficient excess area will be provided within said holder to accommodate said handle of said plastic grocery bag.

14. The invention of claim 13 wherein said center portion of each of said holders and each of said legs thereof has a generally rectangular configuration and each of said holders is at least 8 centimeters long in said given direction.

15. The invention of claim 13 wherein the free ends of the legs of said holder are bent to flare outwardly at portions thereof beyond the portions thereof which are bent inwardly, thereby to form facing convex edges.

16. The invention of claim 15 wherein said facing convex edges touch when each of said holders is in its free state.

17. The invention of claim 13 wherein said legs of each of said holders are long enough to fit over a stiffening rib of a predetermined length which extends down a side of said container from said widened rim thereof.

18. The invention of claim 13 wherein one leg of each of said holders is narrowed from said center portion of said holder so as to form a narrow leg which is dimensioned to fit between a pair of stiffening ribs which extend down from said widened rim of said container and which are spaced apart a predetermined amount.

19. The invention of claim 13 wherein the free end of one leg of each of said holders is bent around and back toward said center portion to have a 180-degree bend so as to form a hook portion for holding a handle of said plastic grocery bag outside the legs of said holder.

20. The invention of claim 13 wherein one leg of each of said holders has a flap which extends from a portion of one of said legs intermediate said center portion and the free end thereof toward said center portion of said holder and is spaced from said one leg to form a hook portion for holding a handle of said plastic bag outside the legs of said holder.

* * * * *